US005711726A

United States Patent [19]

Powers

[11] Patent Number: 5,711,726

[45] Date of Patent: Jan. 27, 1998

[54] BATTING SIMULATOR APPARATUS WITH FORCE, BAT ANGLE, AND VELOCITY READOUT

[76] Inventor: Steven B. Powers, 2126 S. 1900 East, Salt Lake City, Utah 84106

[21] Appl. No.: 275,583

[22] Filed: Jul. 15, 1994

[51] Int. Cl.[6] ..... A63B 69/40

[52] U.S. Cl. ..... 473/453

[58] Field of Search ..... 273/26 R, 25, 273/26 A, 26 B, 29 R, 29 A, 181 J, 191 R, 191 B; 473/417–420, 453, 422, 451

[56] References Cited

U.S. PATENT DOCUMENTS

| | | | |
|---|---|---|---|
| 3,386,733 | 6/1968 | Russo et al. | 273/26 R |
| 3,531,116 | 9/1970 | Trzesniewski | 273/26 |
| 4,461,477 | 7/1984 | Stewart | 273/26 R |
| 4,655,452 | 4/1987 | Huerstel | 273/26 R |
| 4,708,343 | 11/1987 | D'Ambrosio | 273/26 |
| 4,783,070 | 11/1988 | Bauer et al. | 273/26 A |
| 4,907,801 | 3/1990 | Kopp | 273/26 R |
| 4,915,384 | 4/1990 | Bear | 273/26 |
| 4,974,936 | 12/1990 | Hirsch | 273/26 R |
| 5,056,783 | 10/1991 | Matcovich et al. | 273/26 |
| 5,071,122 | 12/1991 | Messina | 273/26 A |
| 5,087,039 | 2/1992 | Laseke | 273/26 R |
| 5,156,402 | 10/1992 | Hart | 273/191 R |
| 5,222,732 | 6/1993 | Robey | 273/29 A |
| 5,228,683 | 7/1993 | Beimel | 273/26 R |
| 5,320,343 | 6/1994 | McKinney | 273/26 R |

*Primary Examiner*—Jessica Harrison
*Assistant Examiner*—Michael O'Neill
*Attorney, Agent, or Firm*—Mallinckrodt & Mallinckrodt

[57] ABSTRACT

An apparatus is disclosed for simulating actual batting practice and is used for training a batter to increase power, proper form and mechanics, and accuracy of the swing of the batter without the use of a pitched ball. The preferred embodiment utilizes a stand on which is mounted a batting target comprising an upper resilient section fixed at its upper end to an upper support member and a lower resilient section fixed at its lower end to a lower resilient support member with the upper and lower resilient sections overlapping at their opposite free ends. A force sensing circuit is located within the batting target. A photoelectric velocity and angle detecting circuit measures the velocity and angle of the bat. Force, velocity and angle circuits are electrically connected to a processor. Also, a visual readout display is electrically connected to the processor for providing visual feedback of force, velocity and angle of the swing to the batter. When the batter strikes the lower resilient section, the force of the impact bends the upper and lower resilient sections. If the force of the swing of the bat is sufficient, the bat passes through the upper and lower resilient sections allowing the batter to complete a full swing. The resilient members return to the original position after the swing of the batter so as to be ready for the batter to swing the bat at the batting target again.

19 Claims, 2 Drawing Sheets

BATTING SIMULATOR APPARATUS WITH FORCE, BAT ANGLE, AND VELOCITY READOUT

BACKGROUND OF THE INVENTION

1. The Field of the Invention

The present invention relates to batting practice machines. More particularly, the present invention is directed to a batting practice or simulation device with a deflectable target for providing adjustable increments of resistance through which a bat may swing, as well as sensors and circuitry to produce a readout of the generated force, bat angle, and velocity of the swing of the bat.

2. Prior State of the Art

Sports players are by nature very competitive, with an ever present desire to improve their play. The desire among baseball players to excel at the sport has lead to a host of apparatus for improving their playing ability.

Providing batting practice to baseball players presents a special problem, as it is not practical to use a pitcher for extended periods of batting practice. But to see a noticeable increase in batting ability, practice is necessary. Unfortunately, the pitcher's arm tends to wear out long before the batters do, especially if there are numerous batters. A further problem is that the balls hit into play must be fielded. This requires a large playing area and the constant attention of fielding players for the benefit of each batter.

Ball pitching machines have been utilized to replace pitchers, but these machines have several inadequacies. They generally require a great number of balls which must be fielded after being hit. The balls pitched by a machine can be hit into a net, but nets inhibit the ability to discern the power and accuracy of the hit. Further, these machines are quite expensive and require constant maintenance.

Various other machines have been used over time to simulate and provide batting practice. One such machine comprises a sensor and transmitting device located in a specialized bat that transmits swing data to a processor and a display system. The use of specially equipped bats with the electronic equipment embedded in them provides an expensive substitute for actually hitting a ball.

Another machine previously tried in the art uses electronic equipment to reflect a signal off of a bat during a swing which is received, processed, and displayed. A backdrop with multiple lights is employed that alternately light up representing various pitches of the ball. This, however, requires sophisticated equipment to be mounted in the bat and provides no resistance to the swing to develop the power and proper reflexes of the batter.

Yet another machine displays a video of a pitcher pitching a ball with a light source where the ball would have traveled. A special bat is part of the machine. The machine, using electronic circuitry, detects when the bat breaks through the path of the intended pitching path. No feedback is provided to the batter as to the force of the swing, nor does it provide accurate information on the directness of the hit. The machine does not provide resistance against which the batter swings to simulate hitting an actually pitched ball.

A method tried in the art is the use of sequencing lights to detect various pitches. A strike zone is simulated that is bounded on two ends by photo detectors, wherein when the bat passes through the reception plane of the first photo detector a timer is started, and when the bat passes through the second plane the timer ends. This timing signal is processed and displayed as a velocity. However, the accuracy of the swing is not measured, nor is resistance against the swing of the bat provided.

Another method used in the art comprises a stand with a vertical member rising from the stand. Attached to the vertical member are a series of rotatably mounted horizontal supports with a baseball-simulating-target attached at the end of each support. When the target is hit, the horizontal support is caused to rotate around the vertical member and the directness and velocity of the hit are measured by the number of rotations around the vertical member. A further feature includes lights that are mounted on other horizontal support brackets in a manner allowing them to shine on to the various targets. Shining a light onto one of the targets represents a pitch and informs the batter of which target to hit. The position of the targets may be moved on the shaft to correspond to different heights of the pitch and to present targets of different heights to the batter. The drawbacks of this method are that it provides little resistance and no means for varying the resistance. Also, no means is provided for calculating the velocity of the bat.

For batting practice to be beneficial, resistance for the development of power, accuracy of the swing, and feedback of the force of the hit are desirable. It is also important in developing proper batting reflexes and mechanics that the batter be able to "swing through" an actual or simulated point of contact with the ball. Therefore, a deflectable target is desirable that allows repetitive hitting against a resistive element and that provides immediate feedback of the accuracy of the hit, the force, the angle of the bat and the velocity of the swing of the bat. Where these benefits could be met without the use of an actual pitched ball, an effective batting practice device would result.

BRIEF SUMMARY AND OBJECTS OF THE INVENTION

The present invention seeks to resolve the above and other problems which have been experienced in the art. More particularly, the apparatus of the present invention constitutes an advancement in the art by providing a batting practice machine to increase power and to improve the reflexes and mechanics of a batter which achieves each of the objects listed below.

It is an object of the present invention to provide a batting practice apparatus with a deflectable target through which a batter may swing for use in training batters and to provide such an apparatus that is capable &providing adjustable resistance against the swing of the batter.

It is also an object of the present invention to provide such an apparatus that will help build the power of the swing of the batters and that will give feedback to the batter by displaying the force, bat angle, velocity of the swing of the bat in real time in a heads-up display for the batter to look at.

It is further an object to provide a batting practice apparatus that is easily adjustable for right and left handed batters and in which the height is also easily adjustable. It is yet further an object of the present invention to provide a batting practice apparatus that is of aid in choosing a proper size bat, in developing speed and accuracy of the swing, as well as stance and posture of the batter.

Another object of the present invention is to provide a batting simulating apparatus that is inexpensive and portable, that does not require a ball pitching machine, and that requires only a small area to use.

Additional objects and advantages of the invention will be set forth in the description which follows and in part will be obvious from the description or may be learned by the practice of the invention. The objects and advantages of the invention will be realized by means of the instruments and combinations particularly pointed out in the independent claims.

To achieve the foregoing objects and in accordance with the invention as embodied and described herein, the present invention comprises an apparatus for use in baseball, softball, cricket, and the like for training that simulates hitting a ball and that provides an adjustable amount of resistance against the swing of the batter in order to develop power, while allowing the batter to complete the swing, and which gives real time feedback to the batter as to the force of the hit, the angle of the bat, and the velocity of the bat.

The presently preferred embodiment comprises two overlapping resilient sections of resilient tube or similarly flexible material with free ends resting in contact with each other. When one of the overlapping ends of the resilient section is hit, the resilient sections are bent and are pushed apart by the bat so as to provide a resistance against the swing of the bat, and to allow the batter to swing through and past the resilient sections as they bend and deflect, allowing the batter to follow through with the swing of the bat. The resilient sections then return to their original position so as to be ready for the next swing of the bat.

Free ends of the two sections of the tube overlap and opposite ends of the two sections of the tube are fixed. The overlapping free ends create a target area. A batter hits one of the resilient sections of the tube within the target area which causes both resilient sections to bend outward, allowing the bat to swing through both sections as they deflect.

The amount of overlap of the free end of the two resilient sections is adjustable. By increasing the overlap or by adjusting the size of the tube, for the batter to swing through both resilient sections, the two resilient sections must bend further, generating greater resistance to the swing. By decreasing the overlap, the resistance to the swing through is reduced.

The overlapping resilient sections are adjustable in height and are adjustable to accommodate both right and left handed batters. At least one of the resilient sections is provided with a means for measuring the force with which the bat hits a target area on the resilient sections. The force of the hit is measured and displayed on a heads-up display behind the target area. A means for detecting and calculating the velocity and angle of the bat is used to display on the heads-up display the velocity and angle of the bat.

The device is quickly set up for either right handed or left handed batters. The device is portable, allowing it to be stored indoors at the end of the batting practice session.

These and other objects and features of the present invention will become more fully apparent from the following description and appended claims, or may be learned from the practice of the invention has set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention is directed to a batting practice device. More specifically, the batting practice device of the present invention, as presently contemplated, entails a deflectable, adjustably resistive target constructed from two sections.

Figure 1:
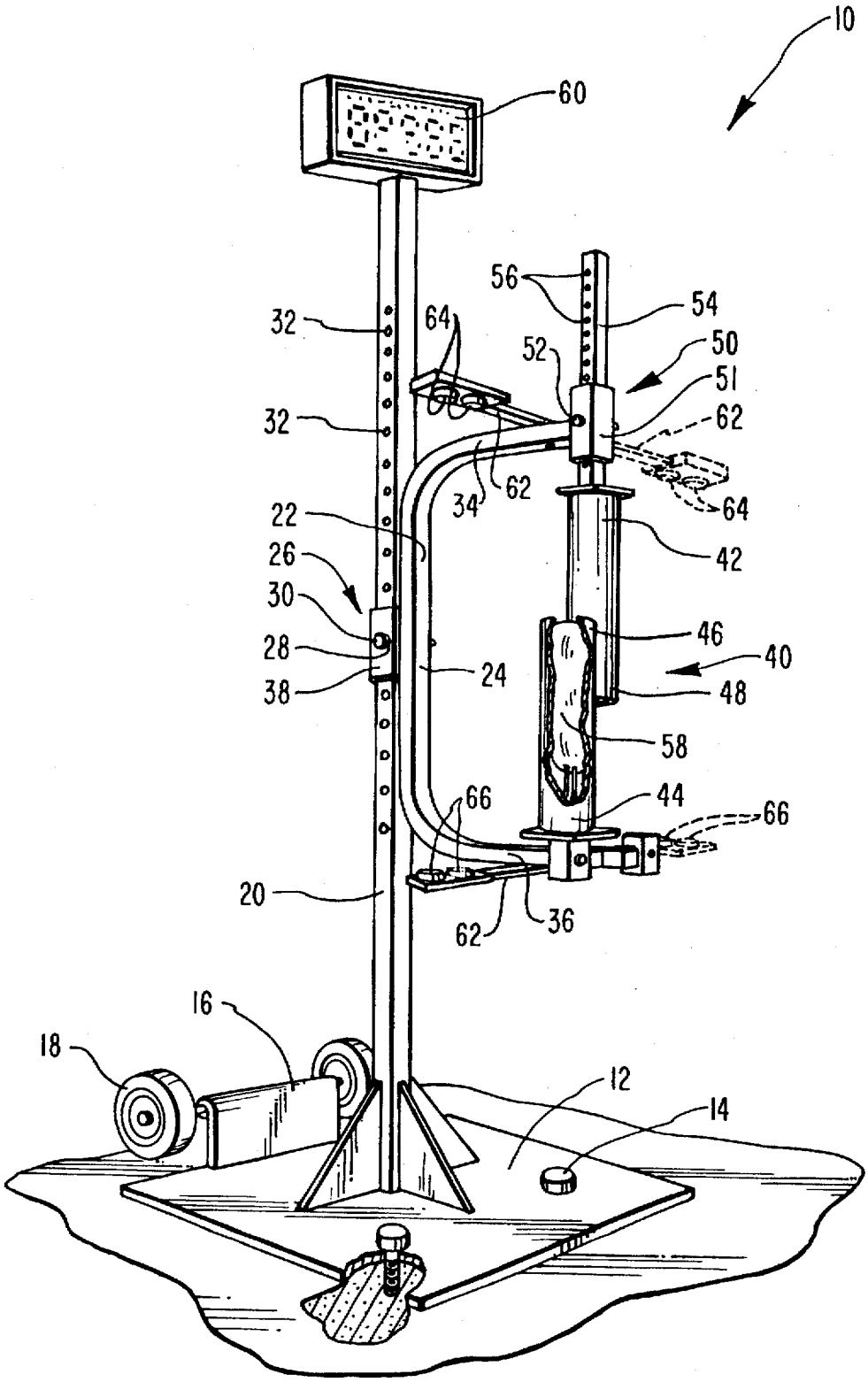
FIG. 1 is a perspective view of a preferred embodiment of the inventive batting practice device in the rest position thereof.
Figure 2:
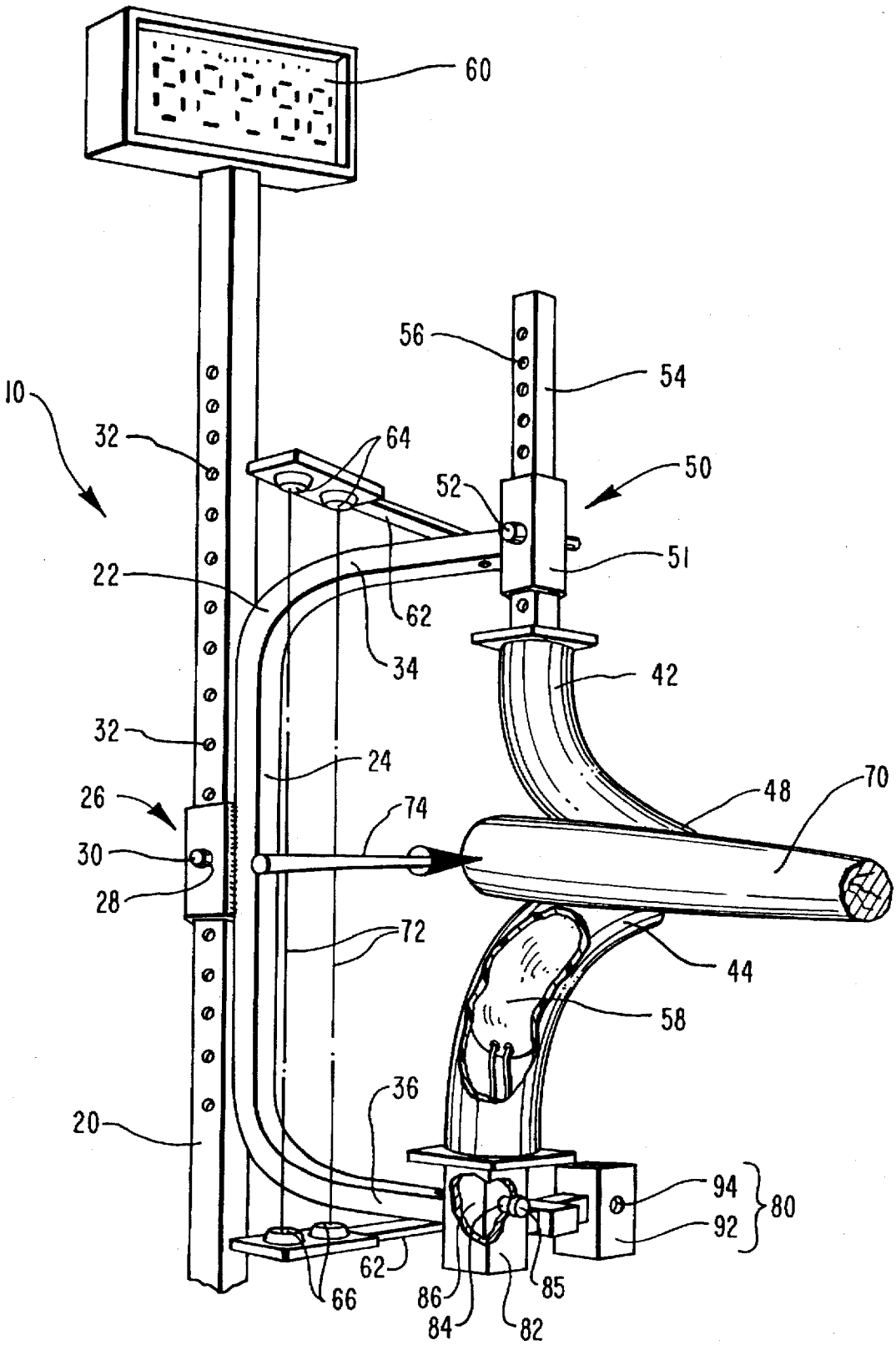
FIG. 2 is a close-up perspective view of the embodiment of the inventive batting practice device of FIG. 1 in the impact position thereof and depicting a bat swinging through the target area of the free ends of two resilient sections of tube.

Referring to the drawings, FIG. 1 and 2 show perspective views of a batting practice device 10. Device 10 rests on a base plate 12 which may be conventionally anchored to the ground. In the presently preferred embodiment of the present invention, the anchoring method is to use bolts 14 which are fastened through base plate 12 into concrete or other secure material on which base plate 12 rests. Base plate 12 is provided with a fixture 16 for wheels 18 for moving and transporting device 10 conveniently. In the presently preferred embodiment of the present invention, fixture 16 consists of a plate that rises from the rear of base plate 12 with an axle therethrough and to which wheels 18 are attached at each end thereof. This allows device 10 to be rotated back upon wheels 18 so as to lift base plate 12 of device 10 free of the ground so that only wheels 18 rest on the ground.

Vertical support member 20 rising from base plate 12 may be used as a handle for transporting device 10 when it is rotated back off base plate 12 onto wheels 18. Vertical support member 20 also acts as a stand for mounting a target 40 which serves as an example of an impact target area means, resiliently articulating between a rest position and an impact position, for providing an impact target area upon which a bat impacts, the impact target area means moving from the rest position to the impact position upon application of a predetermined force by the bat upon the impact target area means and resiliently returning to the rest position upon the bat moving through and past the impact target area means.

Target 40 is attached to vertical support member 20 through the use of a U-bar 22. U-bar 22 has a back portion 24 fixed with a height adjustment mechanism 26 connecting U-bar 22 to vertical support member 20. In the presently preferred embodiment of the present invention, height adjustment mechanism 26 comprises a boxed channel 38 attached to back portion 24 of U-bar 22 with a slot 28 through which a pin 30 may be inserted.

Pin 30 may be free-standing or may be spring loaded into height adjustment mechanism 26. Vertically spaced slots 32 are provided through the side walls of vertical support member 20, so that pin 30 may be inserted directly through boxed channel 38 and through one of the slots 32 in vertical support member 20. By releasing pin 30 and sliding boxed channel 38 with attached U-bar 22 up or down on vertical support member 20 and then reinserting pin 30 into another slot 32 at a selected height, the height of target 40 may be adjusted. Adjustment mechanism 26, and boxed channel 38 slots 32, serve as an example of a means for vertically elevating the impact target means and for stabilizing the impact target area means during application of force by the bat upon the impact target area means.

U-bar 22 has an upper arm 34 and a lower arm 36, each extending horizontally from back portion 24 of U-bar 22. To the free end of each arm 34, 36 is attached one end of target 40. In the presently preferred embodiment, target 40 comprises an overlapping area of the free ends 46, 48 respectively, of an upper resilient section 42 and a lower resilient section 44, which free ends 46, 48 overlap and are adjacent to each other.

To at least one of arms 34, 36 is attached a means for adjusting resistance against the swing of bat 70, an example of which is resistance adjustment mechanism 50 that is, in the preferred embodiment, similar in construction to height adjustment mechanism 26. Resistance adjustment mechanism 50 comprises a boxed channel 51 through which is inserted a pin 52. An inner member 54, with slots 56 extending through and formed at intervals along the length of inner member 54, is slidably received in boxed channel 51. Boxed channel 51 and inner member 54 are secured together at a desired height by pin 52 that is inserted through boxed channel 5 1 and inner member 54. At one end of boxed member 51 is attached one of overlapping resilient sections 42, 44. Resistance adjustment mechanism 50, slots 56, pin 52, inner member 54, and channel box 51 serve as an example of a means for adjusting the impact target area means to require a different predetermined force to move the impact target area means from the rest position to the impact position.

Resistance adjustment mechanism 50 is actuated by releasing pin 52 from inner member 54 and sliding inner member 54 through boxed channel 51 to adjust the same to a desired height, and then reinserting pin 52 through boxed channel 51, and the appropriate slot 56 of inner member 54 to secure inner member 54 in place. In the presently preferred embodiment, resistance adjustment mechanism 50 is attached to upper arm 34 of U-bar 22 and connects to upper resilient section 42. It should be noted though, that resistance adjustment mechanism 50 could be located on bottom arm 36 and connect to lower resilient section 44.

As just discussed, upper resilient section 42 is attached, in the presently preferred embodiment, to resistance adjustment mechanism 50 which is located on upper arm 34 of U-bar 22. Lower resilient section 44 is attached at one end to lower arm 36 on U-bar 22. Free end 46 of lower resilient section 44 extends toward upper arm 34 of U-bar 22 and free end 48 of upper resilient section 42 extends toward lower arm 36. Thereby, the two sections 42, 44 come together in the middle of U-bar 22, and by virtue of a slight offset in the two, overlap each other. The amount of overlap of the two sections 42, 44 determines the amount of resistance felt by a batter attempting to swing through the two sections 42, 44, which resistance is adjusted by resistance adjustment mechanism 50 in the manner previously discussed. Resilient sections 42, 44 may be made from plastic or rubber tube, or other semi-stiff and flexible material.

In the presently preferred embodiment, lower section 44 is embedded with a force detecting sensor 58 which serves to illustrate an example of a force detecting means. The batter swings a bat 70, shown in FIG. 2, to hit lower resilient section 44. As a batter swings bat 70 through target 40, lower resilient section 44 bends and deflects towards a direction 74. Upper resilient section 42, by virtue of its contact with lower resilient section 42, is also carried along with the swing of bat 70 and is likewise deflected in direction 74 of the swing into an impact position. If the swing of the batter is sufficiently powerful, the bat will bend both resilient sections 42, 44 until bat 70 moves through and past the two resilient sections 42, 44 as bat 70 slides off free ends 46, 48 of resilient sections 42, 44. Thus, a resistance to the swing of the batter is provided so as to aid in increasing strength or power of the batter and improve the mechanics of the swing of the batter. After bat 70 moves through target 40 and past the two resilient sections 42, 44 then return to the rest position which is shown in FIG. 1 and is then ready for the next swing of bat 70.

A force detecting sensor 58, which is embedded in lower resilient section 44, is electrically connected to a logic circuit and digital display readout 60 which are located, in the presently preferred embodiment, on the top of vertical support member 20 in a "heads up" fashion. This allows the batter to view the results of the forcefulness of the swing. Swings of bat 70 hitting directly on target 40 will hit force detecting sensor 58 in the center thereof, and will be most effective to move through target 40 and will additionally have a higher force reading at display 60 than a swing of bat 70 which impacts indirectly upon target area 40.

In one contemplated embodiment, a force detecting sensor electrically communicates to a logic circuit or a microprocessor that is housed within digital display readout 60. In such embodiment, digital display device 60 represents the force detecting sensor, such as a piezoresistive semiconductor, an A-to-D convertor, a logic circuit, a decoding circuit, and a means for visually displaying a readout. Air bladder 58 deforms creating a pressure differential. The pressure differential is measured by the force detecting sensor. The measurements are communicated by electrical signals to the A-to-D convertor for conversion into digital signals and are transmitted to the logic circuit, which may be a discrete logic circuit, programmable logic, or a microprocessor. The logic circuit interprets the digital signals and transmits the interpretation electrically to the decoding circuit. The decoding circuit causes a digital readout on digital display device 60 to display a visual representation in real time of the force of the swing of the batter.

A velocity and bat angle detecting circuit may be mounted to arms 34, 36 of U-bar 22 for detecting the velocity and angle of the swing. The velocity and bat angle detecting comprises motion detecting sensors that are mounted on sensor support brackets 62 which are attached to upper and lower arms 34, 36. In the presently preferred embodiment of the present invention, upper sensor support bracket 62 will contain a series of lights 64 of infrared, incandescent, or a specific frequency of light wave that is directed at photoelectric sensors 66 on lower sensor support bracket 62 of lower arm 36. Thus, a light wave barrier 72 exists between upper and lower arms 34, 36 in the path of bat 70 that will be interrupted by the swing of bat 70. The velocity and angle of bat 70 may be then calculated by the amount of time it takes bat 70 to travel the given distance through light barriers 72. Thereby, the movement of bat 70 is monitored by the interruption of light wave barriers 72.

A technique for using photoelectric sensors to calculate the velocity, the acceleration, and the angle of an object passing through a light wave barrier is disclosed in U.S. Pat. No. 4,304,406 to Cromarty, the disclosure of which is incorporated herein by reference.

In one embodiment, several light wave barriers 72 will be formed, each with a light 64 on upper arm 34 and photoelectric sensors 66 to detect the light on lower arm 36. A timing circuit is triggered when bat 70 interrupts a first series of barriers of light waves 72 and is terminated when a second series of barriers of light waves 72 is interrupted. By a predetermined distance between the different series of barriers of light waves 72, and by the time counted by the timing circuit, the velocity and angle of bat 70 may be calculated. The velocity and bat angle calculations are made in the aforementioned logic device and the velocity and bat angle are then displayed on digital display readout 60. The artisan will understand that many variations of the bat angle and velocity detecting and measuring equipment and circuits may also be employed.

To adjust device 10 to accommodate either a right or a left handed batter, one of resilient members 42, 44 must be relocated to an opposite side of the other. As presently contemplated, the preferred method of use is for the batter to hit lower resilient member 44 which contains force detecting sensor 58. Therefore, when the batter must hit from the opposite side, lower resilient member 44 must be relocated to the opposite side of upper resilient member 42. In the presently contemplated embodiment, an adjustment mechanism 80 is located on lower arm 36 of U-bar 22 allowing for simple relocation of lower resilient member 44, which adjustment mechanism 80 is described as follows.

U-bar 22 has two boxed members 82 and 92 on lower arm 36 into which a channel 86 of lower resilient member 44 can be fit. Channel 86, when placed into one of boxed channel 82, 92, is secured therein by a pin 85 placed respectively through a slot 84, 94, as shown in FIG. 2. To relocate lower resilient section 44, pin 85 is pulled out of channel 86 and lower resilient section 44 is moved to the other side of lower arm 36. Channel 86 is inserted into one of boxed members 82, 92 and pin 85 is slid through one of slots 84, 94 and into channel 86. Thus, the foregoing represents an adjustment mechanism to accommodate both left and right handed batters. The artisan will understand that there are many different ways for relocating lower resilient member 44 and for changing device 10 from a right handed to a left handed arrangement.

Thus, by conducting batting practice in the manner and by the method described above, where the batter continuously swings at an adjustably resistive target and observes the force of the swing, the batter may continuously make adjustments to stance, form and technique, noting which changes bring more favorable results. The batter may also use the inventive machine to select a more proper and effective bat.

Table A below, describes a series of manipulative steps for deriving and displaying the force of a swing of a bat that actuates a force measurement means.

TABLE A

| FLOW DIAGRAM FOR THE PRESSURE DETECTION AND DISPLAY METHOD<br>One method for deriving and displaying the force measurement is illustrated in the block diagram steps below: |
|---|
| Step 1: The hit impact of a bat activates a force measurement means.<br>Step 2: The force measurement means produces an electronic signal proportioned to the force of the hit of the bat.<br>Step 3: The electronic signal is transferred to conversion circuitry.<br>Step 4: The electronic signal is converted by the conversion circuitry to a digital signal.<br>Step 5: The digital signal is transmitted to a logic circuit.<br>Step 6: The logic circuit receives the digital signal and converts it into a force figure representing the force of the hit.<br>Step 7: The force figure is transmitted to a digital display decoder. |

TABLE A-continued

| FLOW DIAGRAM FOR THE PRESSURE DETECTION AND DISPLAY METHOD<br>One method for deriving and displaying the force measurement is illustrated in the block diagram steps below: |
|---|
| Step 8: The digital display decoder converts the force figure into display codes for digital display electronics circuit.<br>Step 9: The display codes are displayed on the digital display electronics circuit in a visible manner. |

Table B below, describes a series of manipulative steps for deriving and displaying the velocity and bat angle of a swing of a bat.

TABLE B

| FLOW DIAGRAM FOR THE VELOCITY AND BAT ANGLE DETECTION AND DISPLAY METHOD<br>A sequence of events for deriving and displaying the velocity and bat angle is shown in block sequence form as follows: |
|---|
| Step 1: First and second light wave barriers are established repectively between first set of sensors and transmitter and second set of sensors and transmitters.<br>Step 2: Bat interrupts first light wave barriers from first set of transmitters and sensors.<br>Step 3: Interruption is detected by first sensors.<br>Step 4: Timing sequences are initiated in a timing circuit.<br>Step 5: Bat interrupts second light wave barriers.<br>Step 6: Second interruption is registered.<br>Step 7: Timers are stopped.<br>Step 8: Amount of various time counts are converted to digital signals.<br>Step 9: Digital time signals are input into logic circuit.<br>Step 10: Logic circuit uses known distances between first and second light wave barriers to convert time figure into velocity and bat angle figure.<br>Step 11: Digital display decoder converts the velocity and bat angle figure into display codes for a digital display electronics circuit. |

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A batting practice device comprising:

(a) impact target area means formed of overlapping lengths of resilient tubing, resiliently articulating between a rest position and an impact position, for providing an impact target area upon which a bat directly impacts, the impact target area means moving from the rest position to the impact position upon application of a predetermined force by the bat upon said impact target area means, and resiliently returning to the rest position upon the bat moving through and past the impact target area of the impact target area means;

(b) a base section;

(c) a support member rising vertically from the base section;

(d) a U-bar, adjustably mounted to the support member, having an upper arm and a lower arm each extending to a free end horizontally outward from said support member, and having means attached at the ends of the upper and lower arms for attaching the target;

(e) wherein said target comprises:

(i) an upper length of resilient tubing fixed at an upper end thereof to the free end of the upper arm of the U-bar through an upper resilient tubing support member; and (ii) a lower length of resilient tubing fixed at a lower end thereof to the free end of the lower arm of the U-bar, the upper resilient tubing having a lower end opposite the upper end of the upper resilient tubing, the lower resilient tubing having an upper end opposite the lower end of the lower resilient tubing, and the lower end of the upper resilient tubing being adjacent to and overlapping the upper end of the lower resilient tubing when in the rest position; and (f) means for adjusting the target to require a different predetermined force to move the target from the rest position to the impact position by adjusting the overlap of the lower end of the upper resilient tubing and the upper end of the lower resilient tubing, said means comprising:

(i) a boxed channel having a slot therethrough and attached to the free end of the upper arm of the U-bar;

(ii) the upper resilient section support member having multiple slots therethrough and being slidably received within the boxed channel; and (iii) a pin extending through the slot of the boxed channel and through any one of the multiple slots through the inner member so as to prevent the inner member from vertical movement relative to the boxed channel;

whereby the upper resilient tubing can be adjusted to vary the overlap.

2. A batting practice device as defined in claim 1, further comprising means for adjusting the height of the impact target area means.

3. A batting practice device as defined in claim 2, wherein the means for adjusting the height of the impact target area means comprises multiple vertically spaced slots extending through the support member; a boxed channel having a slot therethrough and attached to the U-bar, the support member being slidably received within the boxed channel; and a pin extending through the slot of the boxed channel and through any one of the multiple vertically spaced slots through the support member so as to prevent the support member from vertical movement relative to the boxed channel.

4. A batting practice device comprising:

(a) impact target area means, resiliently articulating between a rest position and an impact position, for providing an impact target area upon which a bat directly impacts, the impact target area means moving from the rest position to the impact position upon application of a predetermined force by the bat upon said impact target area means, and resiliently returning to the rest position upon the bat moving through and past the impact target area of the impact target area means;

(b) means for vertically elevating the impact target area means and for stabilizing said impact target area means during application of force by the bat upon said impact target area means;

(c) means for adjusting the impact target area means to require a different predetermined force to move the impact target means from the rest position to the impact position;

(d) means, contained within the impact target area means, for measuring the force of the bat upon the impact target area means; and (e) readout means for visually displaying the measured force from the force measuring means.

5. A batting practice device as defined in claim 4, wherein the means for vertically elevating and stabilizing the impact target area means comprises:

a) a base section;

b) a support member rising vertically from the base section; and c) a U-bar, adjustably mounted to the support member, having an upper arm and a lower arm each extending to a free end horizontally outward from said support member, and having means attached at the ends of the upper and lower arms for attaching the impact target area means.

6. A batting practice device as defined in claim 4, wherein the force measurement means comprises an inflatable bladder having an internal increase in pressure therein when the bat impacts upon the impact target area means, the internal pressure being detected by a piezoresistive circuit to produce an electrical signal therefrom proportioned to the internal pressure, the electrical signal being communicated to an analog to digital convertor device, the analog to digital convertor device converting the electrical signal into a digital pressure signal, the digital pressure signal being communicated to a logic circuit, and the logic circuit being electrically connected to display a visual representation of the digital pressure signal on the readout means.

7. A batting practice device as defined in claim 5, wherein the impact target area means comprises:

(a) an upper resilient section fixed at an upper end thereof to the free end of the upper arm of the U-bar; and (b) a lower resilient section fixed at a lower end thereof to the free end of the lower arm of the U-bar, the upper resilient section having a lower end opposite the upper end of the upper resilient section, the lower resilient section having an upper end opposite the lower end of the lower resilient section, and the lower end of the upper resilient section being adjacent to and overlapping the upper end of the lower resilient section when in the rest position.

8. A batting practice device as defined in claim 7, wherein the means for adjusting the impact target area means comprises means for adjusting the overlap of the lower end of the upper resilient section and the upper end of the lower resilient section.

9. A batting practice device as defined in claim 7, wherein the impact target area means further comprises means for retaining the lower resilient section in a front position on one side of the upper resilient section and in a back position on an opposite side of the upper resilient section.

10. A batting practice devise as defined in claim 8, wherein the overlap adjusting means comprises:

(a) a boxed channel having a slot therethrough and attached to the free end of the upper arm of the U-bar;

b) an inner member having multiple slots therethrough and being attached to the upper end of the upper resilient section, the inner member being slidable received within the boxed channel; and c) a pin extending through the slot of the boxed channel and through any one of the multiple slots through the inner member so as to prevent the inner member from vertical movement relative to the boxed channel.

11. A batting practice device comprising:

(a) impact target area means, resiliently articulating between a rest position and an impact position, for providing an impact target area upon which a bat directly impacts, the impact target area means moving from the rest position to the impact position upon application of a predetermined force by the bat upon said impact target area means, and resiliently returning to the rest position upon the bat moving through and past the impact target area of the impact target area means;

(b) means for vertically elevating the impact target area means and for stabilizing said impact target area means during application of force by the bat upon said impact target area means;

(c) means for adjusting the impact target area means to require a different predetermined force to move the impact target means from the rest position to the impact position; and (d) means for detecting an displaying the velocity and bat angle of the bat prior to contact of the bat with the impact target area means.

12. A batting practice device as defined in claim 11, wherein the velocity, and bat angle detecting and displaying means further comprises a means, contained within the impact target area means, for measuring the force of the bat upon the impact target area means, the velocity and bat angle detecting and displaying means displaying the measured force of the bat upon the impact target area means.

13. A batting practice device as defined in claim 11, wherein the velocity, and bat angle detecting and displaying means comprises: a first light source with a corresponding series of first photoelectric sensors and a second light source with a corresponding series of second photoelectric sensors, wherein the bat in motion interrupts a first series of light waves between the first light source and the first series of photoelectric sensors to start a timing circuit that is terminated as the bat in motion interrupts a second series of light waves between the second light source and the second series of photoelectric sensors; and wherein the timing circuit derives the velocity and bat angle of the bat and communicates the same to a means for displaying a visual representation thereof.

14. A batting practice device comprising:

(a) a target, resiliently articulating between a rest position and an impact position, for providing an impact target area upon which a bat impacts, the target moving from the rest position to the impact position upon application of a predetermined force by the bat upon said target, and resiliently returning to the rest position upon the bat moving through and past the target;

(b) a base section;

(c) a support member rising vertically from the base section;

(d) a U-bar, adjustably mounted to the support member, having an upper arm and a lower arm each extending to a free end horizontally outward from said support member, and having means attached at the ends of the upper and lower arms for attaching the target;

(e) wherein said target comprises:

(i) an upper resilient section fixed at an upper end thereof to the free end of the upper arm of the U-bar through an upper resilient section support member; and (ii) a lower resilient section fixed at a lower end thereof to the free end of the lower arm of the U-bar, the upper resilient section having a lower end opposite the upper end of the upper resilient section, the lower resilient section having an upper end opposite the lower end of the lower resilient section, and the lower end of the upper resilient section being adjacent to and overlapping the upper end of the lower resilient section when in the rest position; and (f) means for adjusting the target to require a different predetermined force to move the target from the rest position to the impact position by adjusting the overlap of the lower end of the upper resilient section and the upper end of the lower resilient section, said means comprising:

(i) a boxed channel having a slot therethrough and attached to the free end of the upper arm of the U-bar;

(ii) the upper resilient section support member having multiple slots therethrough and being slidably received within the boxed channel; and (iii) a pin extending through the slot of the boxed channel and through any one of the multiple slots through the inner member so as to prevent the inner member from vertical movement relative to the boxed channel;

whereby the upper resilient section can be adjusted to vary the overlap.

15. A batting practice device as defined in claim 14, wherein the means for adjusting the target comprises means for adjusting the overlap of the lower end of the upper resilient section and the upper end of the lower resilient section.

16. A batting practice device as defined in claim 14, further comprising:

(a) multiple vertically spaced slots extending through the support member;

(b) a boxed channel having a slot therethrough and attached to the U-bar, the support member being slidably received within the boxed channel; and (c) a pin extending through the slot of the boxed channel and through any one of the multiple vertically spaced slots through the support member so as to prevent the support member from vertical movement relative to the boxed channel.

17. A batting practice device as defined in claim 14, wherein the target further comprises means for retaining the lower resilient section in a front position on one side of the upper resilient section and in a back position on an opposite side of the upper resilient section.

18. A batting practice device comprising:

(a) a target, resiliently articulating between a rest position and an impact position, for providing an impact target area upon which a bat impacts, the target moving from the rest position to the impact position upon application of a predetermined force by the bat upon said target, and resiliently returning to the rest position upon the bat moving through and past the target;

(b) a base section;

(c) a support member rising vertically from the base section;

(d) a U-bar, adjustably mounted to the support member, having an upper arm and a lower arm each extending to a free end horizontally outward from said support member, and having means attached at the ends of the upper and lower arms for attaching the target;

(e) means for adjusting the target to require a different predetermined force to move the rest position to the impact position;

(f) wherein said target comprises:

(i) an upper resilient section fixed at an upper end thereof to the free end of the upper arm of the U-bar;

(ii) a lower resilient section fixed at a lower end thereof to the free end of the lower arm of the U-bar, the upper resilient section having a lower end opposite the upper end of the upper resilient section, the lower resilient section having an upper end opposite the lower end of the lower resilient section, and the lower end of the upper resilient section being adjacent to and overlapping the upper end of the lower resilient section when in the rest position; and (iii) means, contained within the target, for measuring the force of the bat upon the target; and (g) readout means for visually displaying the measured force from the force measuring means.

19. A batting practice device as defined in claim 18, wherein the force measurement means comprises an inflatable bladder having an internal increase in pressure therein when the bat impacts upon the target, the internal pressure being detected by a piezoresistive circuit to produce an electrical signal therefrom proportional to the internal pressure, the electrical signal being communicated to an analog to digital convertor device, the analog to digital convertor device converting the electrical signal into a digital pressure signal, the digital pressure signal being communicated to a logic circuit, and the logic circuit being electrically connected to display a visual representation of the digital pressure signal on the readout means.

* * * * *